United States Patent [19]

Wollenmann

[11] 4,081,000

[45] Mar. 28, 1978

[54] WEFT INSERTION NOZZLE ARRANGEMENT FOR A WEAVING MACHINE

[75] Inventor: Hans Peter Wollenmann, Ruti, Switzerland

[73] Assignee: Ruti Machinery Works Ltd., Ruti, Switzerland

[21] Appl. No.: 758,763

[22] Filed: Jan. 12, 1977

[30] Foreign Application Priority Data

Jan. 26, 1976 Switzerland ..... 879/76

[51] Int. Cl.[2] ..... D03D 47/30

[52] U.S. Cl. ..... 139/435

[58] Field of Search ..... 139/435; 226/95, 97

[56] References Cited

U.S. PATENT DOCUMENTS 1,426,351 8/1922 Brooks ..... 139/435

3,229,725 1/1966 Saito ..... 139/435

FOREIGN PATENT DOCUMENTS 1,261,463 4/1961 France ..... 139/435

527,200 5/1955 Italy ..... 139/435

*Primary Examiner*—Henry S. Jaudon

*Attorney, Agent, or Firm*—Donald D. Denton

[57] ABSTRACT

An arrangement for fluid jet insertion of weft threads into the shed of a weaving machine, which arrangement is formed from a main duct having a fluid conveying duct and a transporting duct with their axes forming an obtuse angle with one another, and a thread conveying duct which opens into the main duct with its axis in substantial alignment with the axis of the transporting duct, and the main duct having a narrowed cross-section in the region where the thread conveying duct enters into it.

11 Claims, 3 Drawing Figures

WEFT INSERTION NOZZLE ARRANGEMENT FOR A WEAVING MACHINE

BACKGROUND OF THE INVENTION

The invention relates to an arrangement or device for the insertion of weft threads into a shed in a weaving machine by means of a jet of fluid and with the use of at least one nozzle, which comprises a thread conveying or entrance duct for guiding the weft thread, a fluid conveying duct for guiding the fluid, and a transporting duct for the joint conveying of a weft thread and a fluid, the transporting duct and the fluid conveying duct being each formed by a leg of a common angled main duct, the flow axes of these two legs forming with one another a substantially obtuse angle, and the thread conveying duct opening into the leg forming the transporting duct in alignment with the said leg.

Two prior art arrangements of this type are already known. In one arrangement the main duct is formed of a bore machined from the solid, and in the other known arrangement it is formed of the bore of a bent-over small tube. It is a common feature of both arrangements that the main duct has throughout its length the same diameter. It has been found in practice that with these prior art arrangements there is a considerable escape of fluid through the thread duct. This fluid escapement is a disadvantage since it slows down the speed of the fluid in the transporting duct and this in its turn means that the length of shot which can be achieved for thread insertion is reduced.

The closest prior art known to applicant in connection with this application is German Pat. No. 865,729 and German Offenlegungschrift No. 1,535,454.

SUMMARY OF THE INVENTION

The present invention overcomes this disadvantage by providing a main duct which has a portion of narrowed cross-section in the region where the thread conveying duct enters.

Owing to the portion of reduced cross-section according to the present invention, in the narrowed region of the main duct an increased speed of flow of the fluid is achieved, and, in connection with this, a reduction in pressure. As a result of this reduction in pressure, a suction effect is produced which effectively prevents the outflow of fluid through the thread conveying duct and also provides greater entrainment of the weft thread with the result that a longer insertion shot is achieved.

BRIEF DESCRIPTION OF THE DRAWINGS

The invention will be explained in detail hereinafter with reference to constructional examples and the drawings, in which.

DESCRIPTION OF PREFERRED EMBODIMENTS

Figure 1:
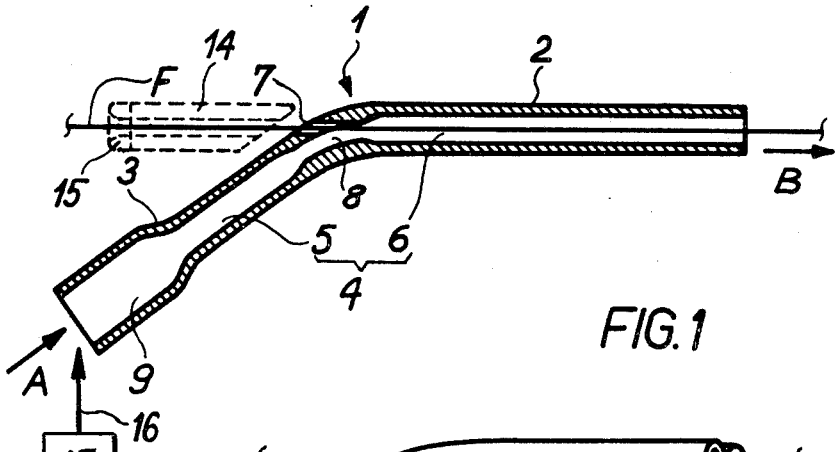
FIG. 1 is a vertical view showing an arrangement according to the present invention with the weft thread insertion nozzle in cross-section.

As shown in FIG. 1, the arrangement for the insertion of weft threads F into a shed of a weaving machine has a small angled or bent-over tube 1 whose two legs 2 and 3 form an obtuse angle with one another. The tube 1 forms a duct which is referred to hereinafter as the main duct 4 and includes the two legs 2 and 3. One leg of the main duct 4 forms the duct designated hereinafter as the fluid conveying duct 5 for guiding the fluid, and the other leg of the main duct is referred to hereinafter as the transporting duct 6 and constitutes the duct for the common guiding of fluid and weft thread F.

In the transition region between the two legs 2 and 3 the tube 1 comprises a weft thread entrance duct 7 in the form of a small bore which is in axial alignment with the axis of the transporting duct 6 and which forms the thread conveying duct for guiding the weft thread F being pulled into and through the transporting duct by entrainment of the thread in the fluid passing through the nozzle arrangement. The thread conveying duct 7 and the fluid conveying duct 5 thus form an acute angle with respect to each other.

To insert weft threads into the shed in the weaving machine the fluid is given a high pressure for a short duration of time, this fluid being fed to the fluid duct 5 by a fluid supply means 17 through a fluid supply conduit 16 that is synchronized with the shed forming mechanism through the drive mechanism of the weaving machine. The fluid flows in the direction of the arrow A through the fluid conveying duct 5 in the direction towards the transporting duct 6, engages the weft thread F extending through the thread duct 7 and the transporting duct 6, carries it along with it, and takes the weft thread into the shed in the direction of the arrow B.

As is shown in FIG. 1 the main duct 4 is provided with a portion of reduced cross-section 8 in the region of entry of the thread duct 7; and the fluid conveying duct 5 comprises in its region adjoining the inlet aperture for the fluid a portion 9 of widened cross-section. Since the diameter of the transporting duct 6 is of the same size as the smaller diameter of the fluid duct 5, the main duct 4 has a constant diameter except for the widening at portion 9 and the narrowing at portion 8.

The portion 9 of widened cross-section in the fluid duct 5, at its inlet aperture, is used for adapting the nozzle to the fluid supply conduit 16 for providing the flow of fluid to the device. The portion 8 of narrowed cross-section in the region of the entry of the thread duct 7 into the main duct 4 provides for increasing the speed of flow of the fluid in the region of the narrowed portion 8 and thus reducing the pressure of the fluid in this region. Owing to this pressure reduction, a suction effect is produced in the fluid relatively to the thread duct 7, so that an escape of fluid through the thread duct 7 is prevented.

For better guiding of the weft thread F between the weft thread conveying mechanism and the nozzles, a small guide tube 14 can be provided so that the thread is guided in the vicinity of the thread duct 7. This guide tube 14 is shown in broken lines in FIG. 1. The guide tube 14 which is spaced from the nozzle can be connected securely to the nozzle, for example, with the use of an adhesive substance or any other suitable attachment means. The guide tube is provided at its thread inlet end with an eyelet 15 of hard material, for example made of a ceramic material.

The nozzle described above is suitable for use with fluids of gaseous type and also fluids of liquid type. In all cases the angle between the fluid conveying duct 5 and the transporting duct 6 is between 130° and 175° and preferably amounts to about 160° to about 165°. The diameter of the fluid conveying duct 5 amounts for example to about 4 mm. in the region of the portion 9 of widened cross-section and about 1.5 to about 2 mm. in the remainder. The diameter of the transporting duct also amounts to about 1.5 to about 2 mm. The diameter of the thread duct amounts to about 1 mm. The length of the transporting duct 6 can vary between about 0.5 and about 20 cm., a preferred length being about 2.5 cm.

Figure 2:
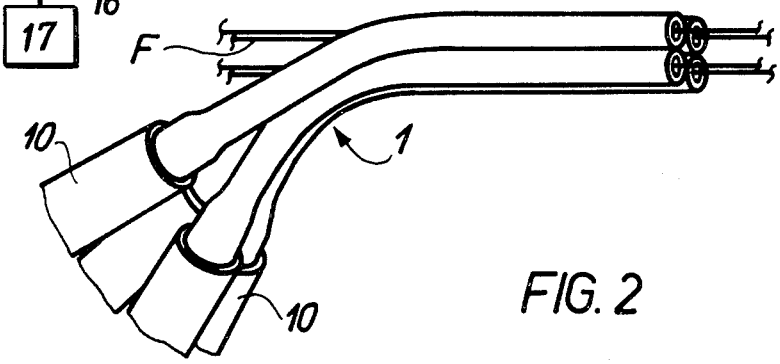
FIG. 2 is a perspective view showing the arrangement with a plurality of nozzles for the insertion of various kinds of weft threads.

Since the nozzle described takes up very little space, it is possible to arrange a plurality of such nozzles in a very small space without any difficulty. This kind of arrangement can be as is shown in FIG. 2 wherein a plurality of nozzles forms the arrangement. The nozzles required are arranged in such a manner that their transporting ducts 6 are situated parallel to one another and at the smallest possible spacing from one another. By suitable choice of the angle between the transporting duct 6 and the fluid conveying duct 5 and by slight turning of the two upper nozzles in the illustration about the axis of the thread, a good physical separation of the feed ducts 10 for the individual fluid ducts can be obtained. Of course it is also possible to arrange more than four nozzles, for example six nozzles, side by side. Any suitable holding means can be used for holding the nozzles in relationship to each other.

The nozzle device shown in FIG. 2 is particularly advantageous in all cases where different kinds of weft threads have to be inserted, for example in color weaving. Since with the illustrated nozzle arrangement, all the nozzles are always in a sufficiently precise position for weft insertion shots, no positioning movements need to be carried out between shots.

Figure 3:
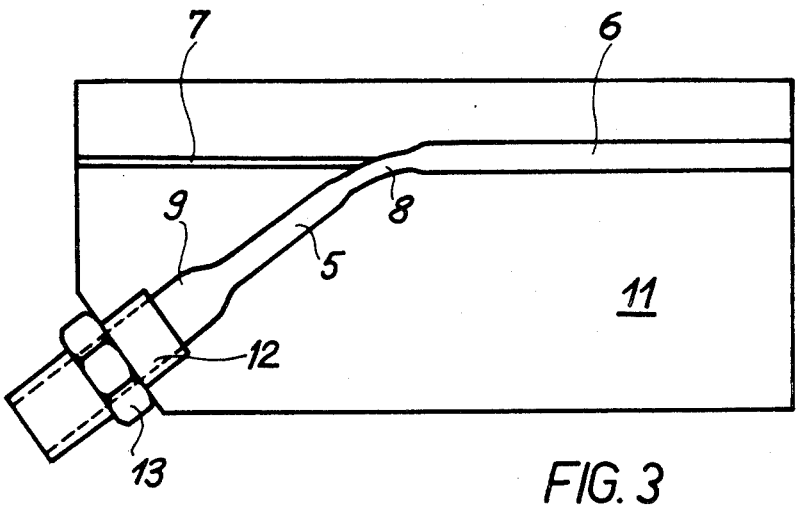
FIG. 3 is a vertical view of an alternate construction showing the arrangement formed from solid material.

In the alternate form of the nozzle arrangement as shown in FIG. 3, there is a variant of the nozzle construction shown in FIG. 1. This form differs from the latter in that the nozzle is not formed of a small tube but is machined from a solid material. This solid material can be for example of prismatic shape. In producing a nozzle of this kind, half the cross-section of the individual ducts is machined, for example by milling, from respective surfaces of two identical plates 11, like the two halves of a casting mould. The plate surfaces concerned are given suitable surface processing and then the two plates 11 are connected to one another for example by bolts or the like. The fluid duct 5 is provided in the region of its inlet aperture with an additional widened portion 12 for receiving a connecting union 13 for the fluid supply conduit 16.

It will be appreciated that when producing the nozzle shown in FIG. 1, it is possible to start from a small tube with a bore which corresponds to the portion 8 of narrowed cross-section and which is then widened in the region of the fluid conveying duct 5 and transporting duct 6. It is also possible to start from a tube having a bore corresponding to the diameter of the transporting duct 6 and then to narrow this bore in the region of the portion 8 of narrowed cross-section by suitable means, for example by drawing.

It has been found that a main duct diameter in the region of the narrowed cross-section that is 70 percent to about 90 percent of the diameter of the remaining transporting duct with the length of the narrowed cross-section of the main duct from about 3 mm. to about 10 mm. forms a nozzle arrangement that produces improved weft thread insertion shots and prevents the outflow of fluid through the thread conveying duct.

It will be appreciated that various changes and/or modifications may be made within the skill of the art without departing from the spirit and scope of the invention illustrated, described, and claimed herein.

What is claimed is:

1. A nozzle arrangement for the insertion of weft threads into a shed in a weaving machine by means of a jet of fluid, said arrangement having at least one nozzle which comprises a weft thread entrance duct, a fluid conveying duct, and a transporting duct for guiding the weft thread and fluid therethrough, said fluid conveying duct and said transporting duct forming a main duct with the axes of the transporting duct and the fluid conveying duct forming substantially an obtuse angle, said thread entrance duct opening into the main duct with its axis in substantial alignment with the axis of the transporting duct, characterized in that the main duct has a portion therein of narrowed cross-section in the region where the thread entrance duct opens into it for entraining said thread when fluid is passing through said nozzle arrangement.

2. The nozzle arrangement according to claim 1 in which the fluid conveying duct and the transporting duct have the same diameter except in the region of narrowed cross-section.

3. The nozzle arrangement according to claim 2 in which the diameter of the thread conveying duct is at least about 0.8 mm. and the length of the region of the said narrowed cross-section is from about 3 mm. to about 10 mm.

4. The nozzle arrangement according to claim 3 in which the length of the region of the said narrowed cross-section is about 5 mm.

5. The nozzle arrangement of claim 3 in which the diameter of the main duct in the region of the narrowed cross-section is from about 70 percent to about 90 percent of the remaining diameter of the transporting duct.

6. The nozzle arrangement according to claim 5 in which the diameter of the main duct in the region with the narrowed cross-section is about 1.6 mm. and in the said remaining portion is about 2 mm. and the length of the transporting duct is about 2.5 cm.

7. The nozzle arrangement according to claim 5 in which the fluid conveying duct has a fluid inlet aperture having a wider cross-section than the cross-section of the remaining portion of the fluid conveying duct.

8. The nozzle arrangement according to claim 1 in which the main duct is formed from a small tube and the thread conveying duct is a bore in the wall of said small tube.

9. The nozzle arrangement according to claim 8 in which a weft thread guide tube is arranged external and substantially in line with the thread conveying duct, said guide tube provided at its weft thread inlet end with an eyelet made of hard material.

10. The nozzle arrangement according to claim 1 in which the main duct and the thread conveying duct are machined from solid material.

11. The nozzle arrangement according to claim 10 in which the solid material consists of two prismatic plates machined in mirror-image relationship to one another to form respective half cross-sections of the thread conveying duct and the main duct, and joined to one another to form the nozzle arrangement.

* * * * *